US009826315B2

(12) United States Patent
Makino

(10) Patent No.: US 9,826,315 B2
(45) Date of Patent: Nov. 21, 2017

(54) ACOUSTIC GENERATOR, ACOUSTIC GENERATION DEVICE, AND ELECTRONIC APPARATUS

(71) Applicant: KYOCERA Corporation, Kyoto-shi, Kyoto (JP)

(72) Inventor: Yutaka Makino, Kirishima (JP)

(73) Assignee: KYOCERA Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 14/898,034

(22) PCT Filed: Jan. 30, 2015

(86) PCT No.: PCT/JP2015/052716
§ 371 (c)(1),
(2) Date: Dec. 11, 2015

(87) PCT Pub. No.: WO2016/047155
PCT Pub. Date: Mar. 31, 2016

(65) Prior Publication Data

US 2017/0195798 A1 Jul. 6, 2017

(30) Foreign Application Priority Data

Sep. 26, 2014 (JP) ..... 2014-196857

(51) Int. Cl.
*H04R 5/02* (2006.01)
*H04R 17/00* (2006.01)
*H04R 1/06* (2006.01)

(52) U.S. Cl.
CPC ..... *H04R 17/005* (2013.01); *H04R 1/06* (2013.01); *H04R 2217/01* (2013.01); *H04R 2499/11* (2013.01)

(58) Field of Classification Search
CPC ..... H04R 17/00; H04R 7/04; H04R 17/005; H04R 2499/11
See application file for complete search history.

(56) References Cited

U.S. PATENT DOCUMENTS

2006/0028097 A1* 2/2006 Sashida ..... H04R 17/00 310/328
2010/0190390 A1 7/2010 Yoshida et al.

FOREIGN PATENT DOCUMENTS

JP 09-205257 A 8/1997
JP 2003-078995 A 3/2003
(Continued)

OTHER PUBLICATIONS

Japanese Reason of Refusal, Japanese Patent Application No. 2015-538784, dated Oct. 20, 2015, 4 pgs. (Japanese Language only).

(Continued)

*Primary Examiner* — Sunita Joshi
(74) *Attorney, Agent, or Firm* — Volpe and Koenig, P.C.

(57) ABSTRACT

There are provided an acoustic generator, an acoustic generation device, and an electronic apparatus capable of enhancing sound pressure and sound quality. An acoustic generator includes a piezoelectric element having a surface electrode; a vibration body to which the piezoelectric element is attached; and a wiring member extending in one direction, having a flat shape, wherein one end portion in the one direction of the wiring member is connected to the surface electrode, and the wiring member is provided with a slit formed in a side of the wiring member which extends in the one direction from the one end portion of the wiring member.

10 Claims, 5 Drawing Sheets

(56) References Cited

FOREIGN PATENT DOCUMENTS

| | | | | |
|---|---|---|---|---|
| JP | 2003125492 | A | * | 4/2003 |
| JP | 2006-005801 | A | | 1/2006 |
| WO | 2008/126719 | A1 | | 10/2008 |

OTHER PUBLICATIONS

International Search Report, PCT/JP2015/052716, dated Apr. 21, 2015, 2 pgs. (Japanese Language only).

* cited by examiner

ACOUSTIC GENERATOR, ACOUSTIC GENERATION DEVICE, AND ELECTRONIC APPARATUS

TECHNICAL FIELD

The present invention relates to an acoustic generator, an acoustic generation device, and an electronic apparatus.

BACKGROUND ART

There is known a small acoustic generator which uses a piezoelectric element as an exciter and is driven with a low voltage. Such an acoustic generator may be assembled for use in a small electronic apparatus such as a mobile computing apparatus, for example.

As such an acoustic generator, an acoustic generator including a vibration plate, a piezoelectric element attached on the vibration plate, and a wiring member connected to the piezoelectric element for application of a drive voltage is known (for example, see Patent Literature 1).

CITATION LIST

Patent Literature

Patent Literature 1: Japanese Unexamined Patent Publication JP-A 2006-5801

SUMMARY OF INVENTION

Technical Problem

Here, since resonance is used in the acoustic generator, a peak and a dip occur in a frequency-sound pressure characteristic, which causes deterioration in sound quality. Further, when the displacement of a piezoelectric element is suppressed as the wiring member connected to the piezoelectric element is less prone to be deformed, the sound pressure deteriorates, and thus, the sound quality deteriorates further. Enhancement in sound quality is further demanded in an acoustic generator.

The invention is devised in view of the above problems, and an object thereof is to provide an acoustic generator, an acoustic generation device, and an electronic apparatus capable of enhancing sound pressure and sound quality.

Solution to Problem

The invention provides an acoustic generator including: a piezoelectric element having a surface electrode; a vibration body to which the piezoelectric element is attached; and a wiring member extending in one direction, having a flat shape, one end portion in the one direction of the wiring member being connected to the surface electrode, the wiring member being provided with a slit formed in a side of the wiring member which extends in the one direction from the one end portion of the wiring member.

Further, the invention provides an acoustic generation device including: the acoustic generator mentioned above; and a housing that accommodates the acoustic generator.

Further, the invention provides an electronic apparatus including the acoustic generator mentioned above; an electronic circuit connected to the acoustic generator; and a casing that accommodates the electronic circuit and the acoustic generator.

Advantageous Effects of Invention

According to the acoustic generator of the invention, it is possible to enhance sound pressure and sound quality. Further, according to the acoustic generation device and the electronic apparatus including the acoustic generator according to the invention, it is possible to enhance acoustic performance.

DESCRIPTION OF EMBODIMENTS

Hereinafter, an example of an acoustic generator according to the present embodiment will be described with reference to accompanying drawings. The invention is not limited to the following embodiments.

Figure 1:
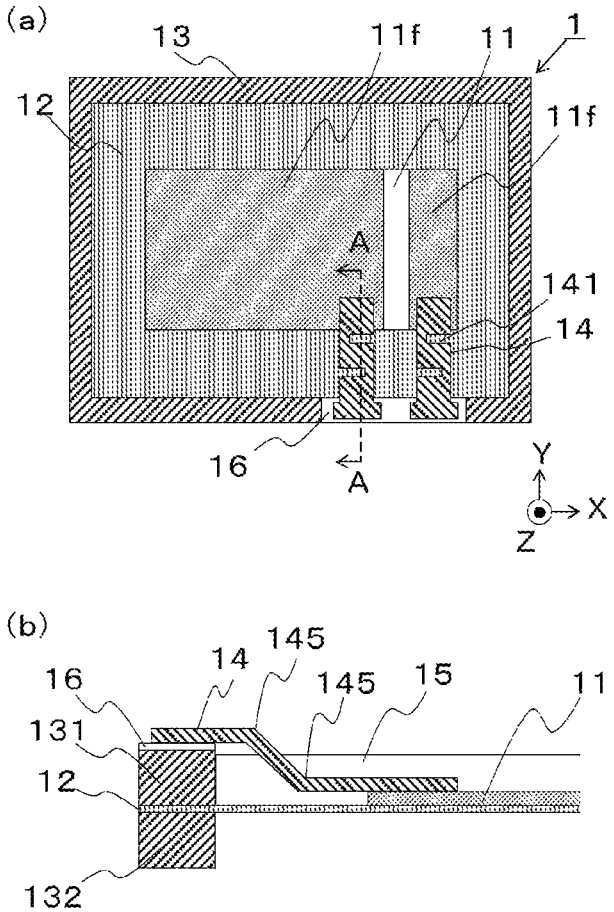
FIG. 1(*a*) is a schematic plan view illustrating an example of an acoustic generator according to the present embodiment and FIG. 1(*b*) is a schematic sectional view taken along the line A-A shown in FIG. 1(*a*)
Figure 2:
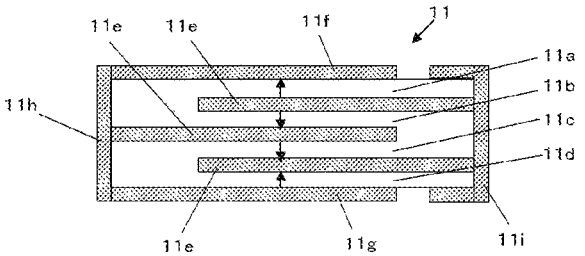
FIG. 2 is a schematic sectional view illustrating an example of a piezoelectric element shown in FIG. 1.

FIG. 1(*a*) is a schematic plan view illustrating an example of an acoustic generator according to the present embodiment, FIG. 1(*b*) is a schematic sectional view taken along the line A-A shown in FIG. 1(*a*), and FIG. 2 is a schematic sectional view illustrating an example of a piezoelectric element according to the present embodiment.

An acoustic generator 1 of an example shown in FIGS. 1(*a*) and 1(*b*) includes a piezoelectric element 11 having a surface electrode 11*f*, a vibration body 12 to which the piezoelectric element 11 is attached, and a wiring member 14 having a flat shape and extending in one direction. One end portion in the one direction of the wiring member 14 is connected to the surface electrode 11*f*, and the wiring member 14 is provided with a slit 141 formed in a side of the wiring member 14 which extends in the one direction from the one end portion of the wiring member 14.

The piezoelectric element 11 is used as an exciter that forms the acoustic generator 1. The piezoelectric element 11 is attached to a main surface of the vibration body 12 by adhesion, for example, and vibrates by the application of voltage to excite the vibration body 12.

The piezoelectric element 11 capable of being used as an exciter includes a stacked body in which piezoelectric layers 11*a*, 11*b*, 11*c*, and 11*d* formed of four ceramic layers and three internal electrode layers 11*e* are alternately stacked, surface electrodes 11*f* and 11*g* formed on one main surface (upper surface) and the other main surface (lower surface) of the stacked body, and external electrodes 11*h* and 11*i* formed on side surfaces on which the internal electrode layers 11*e* are drawn, as shown in FIG. 2.

The piezoelectric layers 11*a*, 11*b*, 11*c*, and 11*d* that form the piezoelectric element 11 are formed of ceramics having a piezoelectric characteristic. Thus, piezoelectric ceramics used in the related art, such as lead zirconate titanate, or a lead-free piezoelectric material such as lithium niobate, lithium tantalite, a Bi-layer shaped compound, or a tungsten bronze structure compound may be used as such ceramics. The thickness of each layer of the piezoelectric layers 11*a*, 11*b*, 11*c*, and 11*d* is set to 0.01 to 0.1 mm, for example, for low voltage driving. Further, in order to obtain a large amount of flexural vibration, it is preferable that the piezoelectric layers preferably has a piezoelectric constant d31 of 200 pm/V or more.

Further, the internal electrode layers 11*e* that form the piezoelectric element 11 are formed by co-firing them together with the ceramics that form the piezoelectric layers. Thus, the internal electrode layers 11*e* are composed of a first internal electrode layer and a second internal electrode layer. The internal electrode layers 11*e* are alternately stacked with respect to the piezoelectric layers 11*a*, 11*b*, 11*c*, and 11*d*, with the piezoelectric layers 11*a*, 11*b*, 11*c*, and 11*d* being vertically interposed therebetween. The first internal electrode layer and the second internal electrode layer are sequentially stacked to apply a drive voltage to the piezoelectric layers 11*a*, 11*b*, 11*c*, and 11*d* interposed therebetween. Various metal materials may be used as a material that forms the internal electrode layers 11*e*. For example, a conductor in which silver or silver-palladium suitable for low temperature firing is used as a main component, or a conductor that contains copper, platinum, or the like may be used as the materials that form the internal electrode layers 11*e*. Further, a ceramic component or a glass component may be contained therein. In a case where the internal electrode layers 11*e* are formed of a material including a metal component that contains silver and palladium and a ceramic component that forms the piezoelectric layers 11*a*, 11*b*, 11*c*, and 11*d*, it is possible to reduce stress due to a shrinkage difference in firing between the piezoelectric layers 11*a*, 11*b*, 11*c* and 11*d* and the internal electrode layer 11*e*, and thus, it is possible to obtain the piezoelectric element 11 with no stacking failure.

As the exciter, it is preferable to use the piezoelectric element 11 in which main surfaces on an upper surface side and a lower surface side have a polygonal shape such as a rectangular shape or a square shape or have a circular or elliptical shape. Using the piezoelectric element 11, and the vibration body 12 and a frame body 13 (which will described later), it is possible to form the thin acoustic generator 1.

The piezoelectric element 11 may have a unimorph structure, but preferably, has a bimorph structure as shown in FIG. 2. That is, it is preferable that polarization is performed so that a polarization direction with respect to a direction of an electric field applied at a certain moment is reversed between one side and the other side in a thickness direction. Thus, it is possible to vibrate the vibration body 12 with high accuracy using a small amount of energy while contributing to reduction in thickness. Further, as the piezoelectric element 11 is flexurally vibrated, it is possible to reduce mechanical loss on a joining surface with the vibration body 12, and thus, it is possible to contribute to the enhancement of sound pressure.

The vibration body 12 that forms the acoustic generator 1 may be formed using various materials such as resin or metal. For example, the vibration body 12 may be formed using a resin film such as polyethylene or polyimide having a thickness of 10 to 200 μm.

The piezoelectric element 11 which is the exciter is attached to the vibration body 12. Specifically, a main surface of the piezoelectric element 11 is joined to a main surface of the vibration body 12 using an adhesive such as an epoxy based resin.

Further, as the piezoelectric element 11 vibrates, the vibration body 12 is vibrated together with the piezoelectric element 11. For example, in a case where the piezoelectric element 11 is a piezoelectric element of a bimorph structure, the wiring member 14 (which will be described later) is connected to the external electrodes. When an electric signal is inputted to the piezoelectric element 11 through the wiring member 14, a piezoelectric layer on a side joined to the vibration body 12 (on the lower surface side of the piezoelectric element 11) is deformed to be shrunk in an in-plane direction perpendicular to a stacking direction, and a piezoelectric layer on the upper surface side of the piezoelectric element 11 is deformed to extend in the in-plane direction perpendicular to the stacking direction, to thereby be bent toward the vibration body 12. Accordingly, as an electric signal is assigned to the piezoelectric element 11, the piezoelectric element 11 is flexurally vibrated, to thereby apply flexural vibration to the vibration body 12.

Further, the frame body 13 is provided to support an outer peripheral portion of the vibration body 12, as necessary. A frame member of which an inner peripheral shape and an outer peripheral shape are rectangular may be used as the frame body 13, for example. In the example shown in FIG. 1, the frame body 13 includes a one main surface side frame member 131 provided on one main surface side, and an other main surface side frame member 132 provided on the other main surface side, and supports the vibration body 12 with the outer peripheral portion of the vibration body 12 being interposed therebetween. In other words, the outer peripheral portion of the vibration body 12 is fixedly interposed by the one main surface side frame member 131 and the other main surface side frame member 132 that form the frame body 13. In this way, the vibration body 12 is supported by the frame body 13 in a state of being tensioned within the frame body 13. An inner portion of the vibration body 12 which is not interposed between the one main surface side frame member 131 and the other main surface side frame member 132 that form the frame body 13 may be freely vibrated.

The thickness of the one main surface side frame member 131 and the other main surface side frame member 132 that form the frame body 13 may be 100 to 5000 μm, for example. Further, the one main surface side frame member 131 and the other main surface side frame member 132 that form the frame body 13 may be formed of various materials such as glass, metal, or resin. In the case of glass, since the mechanical strength is high, deformation of the one main surface side frame member 131 and the other main surface side frame member 132 is small, and sound quality is stable. Further, in the case of metal, the stiffness is lower than that of glass, and thus, a difference between a resonance peak and a dip is further dispersed, so that a frequency characteristic can be flattened. Accordingly, it is possible to achieve enhancement of sound quality due to flattening of sound pressure. In addition, in the case of resin, stiffness is smaller than that of metal, and thus, a difference between a resonance peak and a dip is dispersed, so that the frequency characteristic can be flattened. Accordingly, it is possible to achieve enhancement of sound quality due to the flattening of sound pressure.

Further, the frame body 13 (the one main surface side frame member 131 and the other main surface side frame member 132) may be formed by arranging plural members for assembly in a peripheral direction and joining the plural members.

The invention is not limited to the example shown in FIG. 1, the acoustic generator may have a configuration in which the frame body 13 is formed by the one main side frame member 131 provided only on one main surface side of the vibration body 12 and the outer peripheral portion of the vibration body 12 is attached thereto.

Further, in the present embodiment, only an example in which the frame body 13 is provided is shown, but the frame body 13 is not an essential component, and a configuration in which the frame body 13 (the one main surface side frame member 131 and the other main surface side frame member 132) is not be provided may be used.

Further, FIG. 1 shows an example in which the frame body 13 is formed in a rectangular shape, and the shape of an inner region thereof is a rectangular shape. In this regard, by setting its aspect ratio to be larger than 1, it is possible to contribute to the dispersion of resonance, and to contribute to the flattening of peaks and dips. Here, the shape may be a polygon such as a square, a parallelogram, a trapezoid or a regular N polygon, or may be a circular shape or an elliptical shape.

Further, a case where one piezoelectric element 11 is provided is shown in FIG. 1, but the number of piezoelectric elements 11 is not limited to one. In addition, a case where the piezoelectric element 11 is provided on one main surface of the vibration body 12 is shown in FIG. 1, but the piezoelectric element 11 may be provided on both main surfaces of the vibration body 12.

A resin layer 15 may be provided inside the frame body 13 (the one main surface side frame member 131). As a resin that forms the resin layer 15, an acrylic based resin, an epoxy based resin, a radical polymerization based resin, a cation polymerization based resin, a phenol based resin, or the like may be used, for example.

It is not essential that the resin layer 15 is provided to cover the surface of the piezoelectric element 11 as long as the resin layer 15 is provided to cover the vibration body 12. However, when the resin layer 15 is provided to cover the surface of the piezoelectric element 11 so that the piezoelectric element 11 is buried in the resin layer 15, it is possible to cause an appropriate damping effect. In the drawing, a state where the resin layer 15 is formed at the same height as that of the one main surface side frame member 131 is shown, but the resin layer 15 may be formed to be higher than the height of the one main surface side frame member 131.

The wiring member 14 is formed in a flat shape that extends in one direction. For example, the wiring member 14 is formed in a long and thin plate shape having a width of 0.5 to 5.0 mm and a thickness of 0.01 to 1.0 mm using a metal plate, a printed circuit board, or the like. The wiring member 14 is provided in a pair on a positive side and a negative side. One end portion of each wiring member 14 in the one direction (length direction) is joined to the surface electrode 11*f* of the piezoelectric element 11 through a conductive joining material such as solder, conductive resin paste, anisotropic conductive paste or an anisotropic conductive sheet. The other end portion of the wiring member 14 is fixed onto a main surface (upper surface in the drawing) of the frame body 13 (the one main surface side frame member 131) through an adhesive, a thermocompression bonding sheet, or the like. An external wiring connected to an external circuit is separately connected to the other end portion of the wiring member 14 for power supply. In this way, in a case where the frame body 13 that supports the vibration body 2 is provided, the other end portion of the wiring member 14 may be fixed to the frame body 13.

In a case where the frame body 13 (the one main surface side frame member 131) is formed of a conductor such as metal, an intermediate layer 16 formed of an insulating material may be interposed between the frame body 13 and the other end portion of the wiring member 14 to prevent a short circuit. Further, a connection point from an external circuit, that is, a terminal which is a so-called electrode terminal may be provided on the main surface of the frame body 13.

Further, in a case where the frame body 13 is not provided, the other end portion of the wiring member 14 may be directly fixed to an external circuit.

Further, one end portion in the one direction of the wiring member 14 is connected to the surface electrode 11*f*, and the wiring member 14 is provided with the slit 141 formed in a side of the wiring member 14 which extends in the one direction from the one end portion of the wiring member 14. Here, the wiring member 14 shown in the drawing has a long shape that extends in an elongated manner in a direction of being drawn from the piezoelectric element 11, and extends in one direction from one end portion of the wiring member 14 connected to the surface electrode 11*f* of the piezoelectric element 11. Here, the one direction refers to a direction extending between one end portion of the wiring member 14 and to the other end portion thereof. Accordingly, the configuration in which the slit 141 is formed in the side that extends in the one direction from the one end portion of the wiring member represents a configuration in which the slit 141 is formed toward the inside from a side surface (one side surface or the other side surface) in a width direction perpendicular to the direction where one end portion is connected to the other end portion, preferably, along the width direction.

In the example shown in FIG. 1, the slits 141 are formed in both sides, in which the slit 141 that is formed in one side (extends from one side surface) and the slit 141 that is formed in the other side (extends from the other side surface) are disposed at different positions in the length direction. Further, the slit 141 that extends from one side surface and the slit 141 that extends from the other side surface have the same length.

The wiring member 14 may be formed only by a slit 141 provided from one side surface toward the width direction. In this case, the number of slits 141 may be one or plural.

The length of the slit 141 formed in the wiring member 14 is 0.25 to 4.5 mm, for example. It is preferable that the length of the wiring member 14 is set to 50% or more and 95% or less of the width of the wiring member 14. That is, it is preferable that the slits 141 are provided so that tips of plural slits 141 overlap each other when seen in the direction (length direction) extending between one end portion of the wiring member 14 and the other end portion thereof. Thus, it is possible to remarkably change the shape of the wiring member 14, to thereby further enhance the sound pressure characteristic and reduce peaks and dips.

Further, it is advantageous that the width of the slit 141 is wide and an interval (pitch) between the adjacent slits 141 is narrow. Accordingly, it is possible to remarkably change the shape of the wiring member 14, and thus, it is possible to further enhance the sound pressure characteristic and reduce peaks and dips. Here, in a case where the interval between the slits 141 is set to be narrower than the thickness of the wiring member 14, it is necessary to consider a concern that a problem of fracture due to vibration amplitude when sound is generated or a problem of fusing due to rise in temperature when an electric current flows may occur. Accordingly, it is preferable that the width of the slit 141 is set to 0.05 to 1.0 mm, for example, and it is preferable that the interval of the adjacent slits 141 is set to 0.05 to 1.0 mm, for example.

Further, it is preferable that the slit 141 of the wiring member 14 is disposed between the piezoelectric element 1 joined to the one end portion and the frame body 13 joined to the other end portion. It is preferable that the slit 141 of the wiring member 14 is disposed at a position that does not reach the corners of the piezoelectric element 1 in view of durability of the wiring member 14, for example.

Further, the tip of the slit 141 may be flat, or may have a roundish shape. Further, the tip of the slit 141 may be formed to have a width which is greater than the width of the other portion. Further, the slit 141 may be formed in a tapered shape in which the width gradually becomes more narrow toward the tip of the slit 141, or may be formed in a tapered shape in which the width gradually becomes wider toward the tip of the slit 141.

Figure 3:
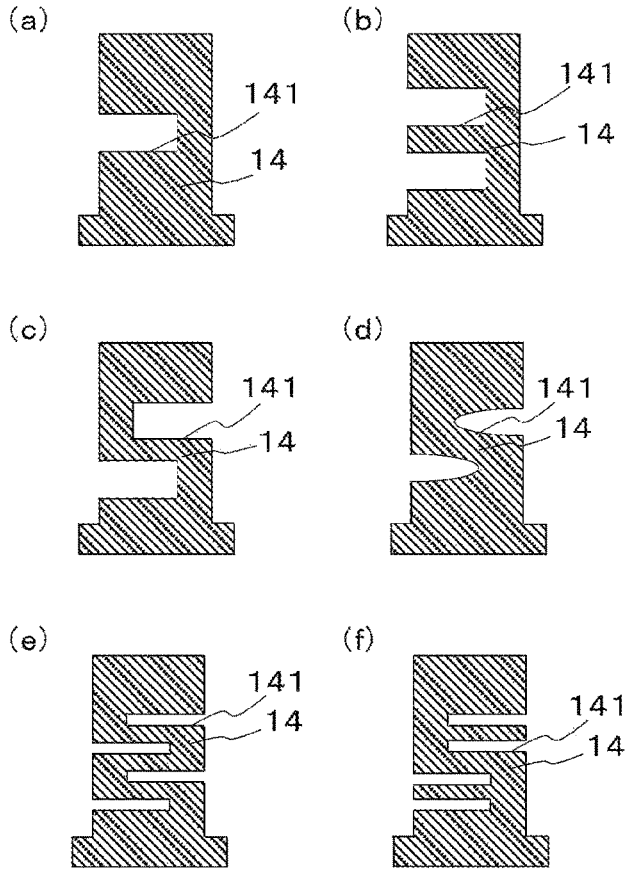
FIGS. 3(*a*) to 3(*f*) are schematic plan views of variations of a wiring member shown in FIG. 1.

Here, examples of configurations capable of being obtained instead of the configuration shown in FIG. 1 are shown in FIG. 3. For example, the wiring member 14 shown in FIG. 3(*a*) has a configuration in which one slit 141 is provided from one side surface in the width direction, and the wiring member 14 shown in FIG. 3(*b*) has a configuration in which two slits 141 are provided from one side surface in the width direction. Further, the wiring member 14 shown in FIG. 3(*c*) has a configuration in which the width of the slit 141 (the distance of the wiring member 14 in the one direction) is greater than that of the wiring member 14 shown in FIG. 1. Further, the wiring member 14 shown in FIG. 3(*d*) has a configuration in which the shape of the slit 141 is formed in a semi-elliptical shape. In addition, the wiring member 14 shown in FIG. 3(*e*) has a configuration in which the slit 141 that extends from one side surface in the width direction and the slit 141 that extends from the other side surface in the width direction are alternately and repeatedly provided. Furthermore, the wiring member 14 shown in FIG. 3(*f*) has a configuration in which two slits 141 that extend in the width direction from one side surface are provided in parallel and two slits 141 that extend in the width direction from the other side surface are provided in parallel. The configuration of the slit 141 is not limited to the examples shown in the drawing.

With such a configuration, the shape of the wiring member 14 is easily changed in a direction (Z direction) perpendicular to the main surface of the vibration body 12, and also, in directions (X direction and Y direction) parallel to the main surface of the vibration body 12. That is, since the shape of the wiring member 14 is easily changed in all directions, it is possible to alleviate a force that suppresses displacement of the piezoelectric element 11. Further, since the main surface of the wiring member 14 is distorted in multiple directions, vibration propagated from the vibration body 12 is reflected and dispersed. Damping of vibration at a resonance frequency or division due to development of spurious vibration occurs due to the effects, and thus, it is possible to reduce peaks and dips in a frequency-sound pressure characteristic. Accordingly, it is possible to enhance the sound pressure and sound quality of the acoustic generator 1.

Here, it is preferable that the wiring member 14 is provided with plural slits 141 and the slits are formed in both side portions of the wiring member 14 which extend in one direction from the one end portion of the wiring member 14. In other words, it is preferable that the slits 141 respectively extend in the width direction from both side surfaces (one side surface and the other side surface), and thus, distortion easily occurs, so that remarkable effects can be obtained.

Figure 4:
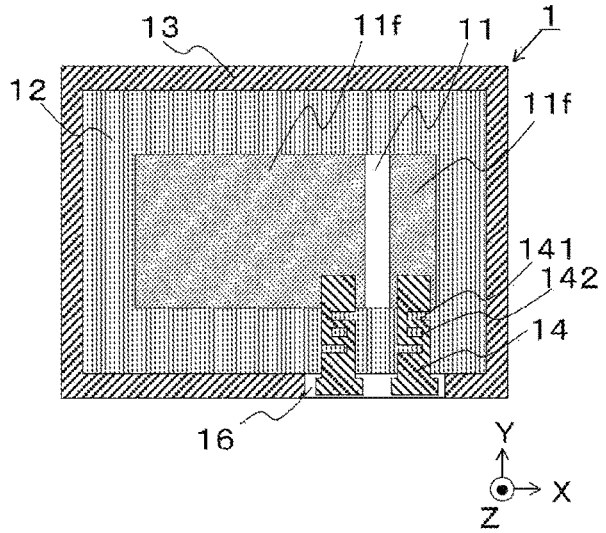
FIG. 4 is a schematic plan view illustrating another example of the acoustic generator according to the present embodiment.

FIG. 4 is a schematic plan view illustrating another example of the acoustic generator according to the present embodiment. In the acoustic generator shown in FIG. 4, the wiring member 14 is provided with plural slits 141 and a hole 142 formed between adjacent slits 141. In FIG. 4, there is shown a configuration in which one hole 142 is provided between a total of two slits of which one slit 141 extends in the width direction from one side surface and one slit 141 extends in the width direction from the other side surface. However, in a case where three slits 141 are provided, two (one between every two slits 141) holes 142 may be provided, and in a case where four slits 141 are provided, three (one between every two slits 141) holes 142 may be provided. As the hole 142 is formed between the slit 141 provided from one side surface in the width direction and the slit 141 provided from the other side surface in the width direction, the shape of the wiring member 14 is more easily changed in all directions of the X direction, the Y direction, and the Z direction. Thus, it is possible to further alleviate the force that suppresses the displacement of the piezoelectric element 11, to thereby further enhance the sound pressure. Further, as the hole 142 is provided between the plural slits 141 of the wiring member 14, it is possible to easily deform the wiring member 14 while suppressing fracture of the wiring member 14, compared with a configuration in which the slit 141 is provided, instead of the hole 142, at a position where the hole 142 is provided.

Further, it is preferable that the hole 142 is disposed at a central portion of the wiring member 14 in the width direction. Further, the hole 142 may be a hole extending in the width direction of the wiring member 14. In addition, it is preferable that the width (the distance thereof in the direction (length direction) extending between one end portion of the wiring member 14 and the other end portion thereof) of the hole 142 is larger than an interval between the slit 141 and the hole 142. With such a configuration, the opening of the hole 142 is widened, to thereby make it possible to easily deform the wiring member 14. The hole 142 may be formed in a rectangular shape, or may have a roundish shape in ends of the rectangular shape. Further, the hole 142 may be formed in an exactly circular shape or an elliptical shape.

Figure 5:
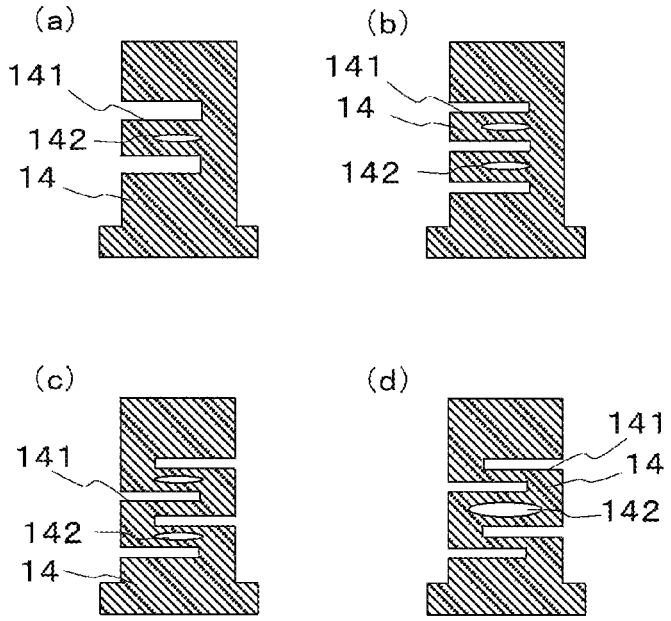
FIGS. 5(*a*) to 5(*d*) are schematic plan views of variations of a wiring member shown in FIG. 4.

Here, examples of configurations capable of being obtained instead of the configuration shown in FIG. 4 are shown in FIG. 5. For example, FIG. 5(*a*) shows a configuration in which two slits 141 are provided from one side surface in the width direction and the hole 142 is provided between the slits 141. FIG. 5(*b*) shows configuration in which three slits 141 extend in the width direction from one side surface and the hole 142 is provided between adjacent slits 141. Further, FIG. 5(*c*) and FIG. 5(*d*) show configurations in which a total of four slits of which two slits 141 extend in the width direction from one side surface and two slits 141 extend in the width direction from the other side surface are provided. Here, FIG. 5(*c*) shows a case where the hole 142 is provided at two positions between the slits 141, and FIG. 5(*d*) shows a case where the hole 142 is provided at one position between the slits 141. In this way, a configuration in which a portion where the hole 142 is provided between the slit 141 extending in the width direction from one side surface and the slit 141 extending in the width direction from the other side surface and a portion where the hole 142 is not provided therebetween are provided may be used.

Figure 6:
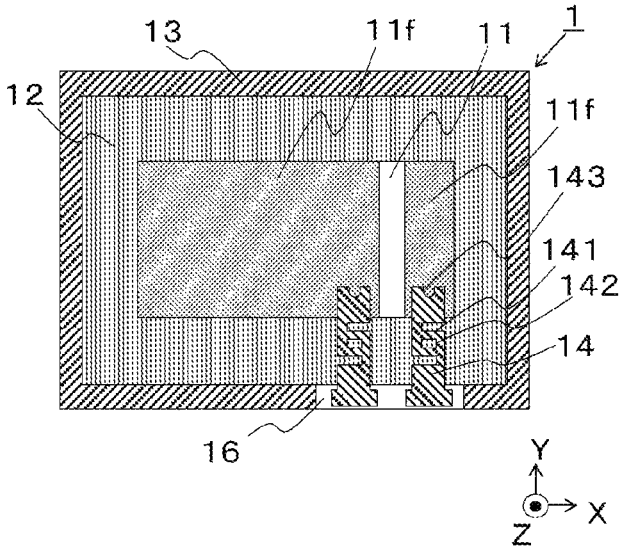
FIG. 6 is a schematic plan view illustrating still another example of the acoustic generator according to the present embodiment.

FIG. 6 is a schematic plan view illustrating still another example of the acoustic generator according to the present embodiment. In the acoustic generator shown in FIG. 6, one end portion of the wiring member 14 is joined to the surface electrode 11*f* provided on the main surface of the piezoelectric element 11, and the one end portion of the wiring member 14 is provided with a notch 143 extending in the one direction (length direction) from an end surface of the wiring member 14. As the one end portion of the wiring member 14 which forms a joining portion with the surface electrode 11*f* is provided with the notch 143 extending in the one direction (length direction) from the end surface of the wiring member 14, the one end portion of the wiring member 14 is easily deformed according to deformation of the piezoelectric element 11. Accordingly, it is possible to further alleviate the force that suppresses the displacement of the piezoelectric element 11, to thereby further enhance the sound pressure. Further, a conductive joining material is inserted into the notch 143, and thus, it is possible to reliably join the one end portion of the wiring member 14 and the surface electrode 11*f*.

In the example shown in the drawing, the wiring member 14 is joined to the piezoelectric element 11 so as to extend in a direction perpendicular to a long axis of the piezoelectric element 11, that is, so that the long axis of the piezoelectric element 11 and the one direction (length direction) of the wiring member 14 are perpendicular to each other. Further, the notch 143 is provided to extend in the one direction (length direction) of the wiring member 14. Since the piezoelectric element 11 vibrates to be easily bent in the long axis direction, when the notch 143 is provided to extend in the one direction (length direction) of the wiring member 14, the one end portion of the wiring member 14 easily follows flexural vibration (deformation) of the piezoelectric element 11. Accordingly, it is preferable that the notch 143 is provided to extend in the one direction (length direction) of the wiring member 14.

Figure 7:
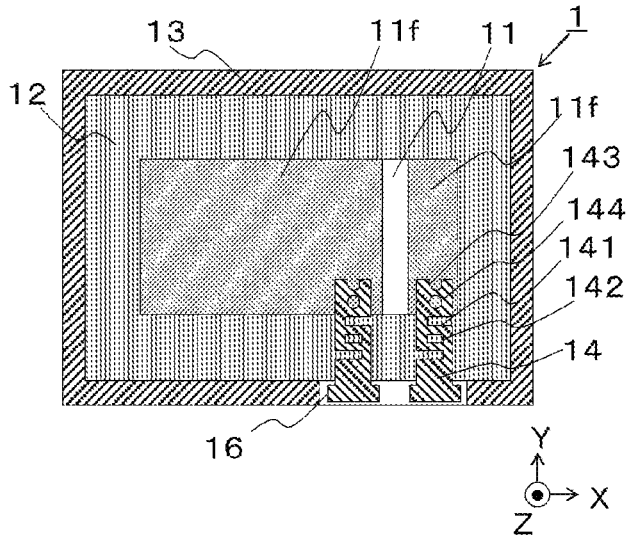
FIG. 7 is a schematic plan view illustrating still another example of the acoustic generator according to the present embodiment.

FIG. 7 is a schematic plan view illustrating still another example of the acoustic generator according to the present embodiment. As shown in FIG. 7, a configuration in which one end portion of the wiring member 14 is provided with a through hole 144 may be used. As the through hole 144 is provided in one end portion of the wiring member 14 which forms a joining portion with the surface electrode 11*f*, the one end portion of the wiring member 14 is easily deformed by further following deformation of the piezoelectric element 11. Accordingly, it is possible to further alleviate the force that suppresses the displacement of the piezoelectric element 11, to thereby enhance the sound pressure. Further, a conductive joining material is inserted into the through hole 144, and it is possible to reliably join the one end portion of the wiring member 14 and the surface electrode 11*f*. The invention is not limited to the configuration shown in the drawing. In a case where the notch 143 is not provided, the through hole 144 may be provided.

Further, it is preferable that the wiring member 14 has a bending portion 145 that is bent in the thickness direction. In the example shown in FIG. 1(*b*), two bending portions 145 are provided, but it is preferable that two or more bending portions 145 are provided. As the bending portions 145 are provided, it is possible to easily deform the wiring member 14 in the thickness direction (Z direction), and to further alleviate the force that suppresses the displacement of the piezoelectric element 11, to thereby enhance the sound pressure. Further, for example, in a case where the thickness of the frame body 13 (the one main surface side frame member 131) is different from the thickness of the piezoelectric element 11, it is possible to join the one end portion of the wiring member 14 to the surface electrode 11*f* in parallel, and to join the other end portion of the wiring member 14 to the terminal 130 in parallel, to thereby increase a joining area. Here, when the piezoelectric element 11 is formed to be thinner than the frame body 13 (the one main surface side frame member 131), the sound quality improvement effect increases.

Further, it is preferable that the wiring member 14 is formed of any one of phosphor bronze, brass, nickel silver, and Corson-based alloy. Since these materials are excellent in a spring property and have a wide elastic deformation area with respect to stress, it is possible to enhance reliability.

Next, a manufacturing method of the acoustic generator according to the present embodiment will be described.

First, a ceramic green sheet forming the piezoelectric layers 11*a*, 11*b*, 11*c*, and 11*d* is prepared. Specifically, a calcined powder of piezoelectric ceramics, a binder formed of an acrylic organic polymer or a butyral organic polymer, and a plasticizer are mixed to prepare slurry. Then, a green sheet is prepared using the slurry by a tape forming method such as a doctor blade method or a calender roll method. As the piezoelectric ceramics, any material having a piezoelectric characteristic may be used. For example, perovoskite-type oxide formed of lead zirconate titanate ($PbZrO_3$—$PbTiO_3$), or the like may be used. Furthermore, the plasticizer may employ dibutyl phthalate (DBP), dioctyl phthalate (DOP), or the like.

Then, conductive paste which is used to form the internal electrode layer 11*e* is coated on the green sheet in a patterned shape of the internal electrode layer 11*e* by a printing method such as screen printing, for example. The conductive paste is prepared by adding a binder and a plasticizer to metal powder formed of silver-palladium and mixing them. Plural green sheets on which the conductive paste is printed are stacked to prepare a green stacked body. The green stacked body is heated at a predetermined temperature to perform a debindering process, and then, is fired at a temperature of 900° C. to 1200° C. in a firing bowl that uses aluminum oxide, zirconium oxide, magnesium oxide, or the like as a main component. Thus, a stacked body, which is a sintered body, in which the plural piezoelectric layers 11*a*, 11*b*, 11*c*, and 11*d* and the plural internal electrode layers 11*e* are stacked is prepared. The stacked body may be formed in a predetermined shape by performing a grinding process using a surface grinding machine, for example.

Conductive paste which is used to form the surface electrodes 11*f* and 11*g* and the external electrodes 11*h* and 11*i* is printed on main surfaces and side surfaces of the stacked body by a printing method such as screen printing, for example, to form patterned shapes of the surface electrodes 11*f* and 11*g* and the external electrodes 11*h* and 11*i*, and then, the resultant is dried. Then, a baking process is performed at a temperature of 650° C. to 750° C. to form the surface electrodes 11*f* and 11*g* and the external electrodes

11*h* and 11*i*. The conductive paste which forms the surface electrodes 11*f* and 11*g* and the external electrodes 11*h* and 11*i* is a sliver glass containing conductive paste prepared by adding a binder, a plasticizer, and a solvent to a mixture of conductive particles using silver as a main component and glass.

The electric connection between the surface electrodes 11*f* and 11*g* and the internal electrode layers 11*e* may be performed by a through conductor that penetrates the piezoelectric layers 11*a*, 11*b*, 11*c*, and 11*d*, instead of the external electrodes 11*h* and 11*i*. In this case, for example, before the printing of the conductive paste which forms the surface electrodes 11*f* and 11*g*, a through hole may be formed in the green sheet by a punching process using a die or a drilling process using laser work, and the through hole may be filled with conductive paste which is used to form a through conductor by a printing method. As the conductive paste which forms the through conductor, the same paste as the conductor paste which forms the surface electrodes 11*f* and 11*g* and the external electrodes 11*h* and 11*i*, in which the viscosity thereof is adjusted by adjusting the amount of a binder or a solvent, may be used.

By performing a polarization process for the piezoelectric element 11 to assign piezoelectric activation, a vibration generating body that is flexurally vibrated due to voltage application is obtained. In the polarization process, an electric potential difference of 2 kV/mm to 3 kV/mm is applied for an application time of several seconds at an ambient temperature of 15° C. to 35° C., for example, using a direct current power supply. The voltage, the ambient temperature, and the application time are appropriately selected according to properties of the piezoelectric material.

Then, the vibration body 12 is fixedly joined to the other main surface of the piezoelectric element 11 using a joining material. For example, in a case where an anaerobic resin adhesive is used as the joining material, anaerobic adhesive paste is coated by a screen printing method or otherwise at a predetermined position on one main surface side of the vibration body 12. Then, by applying pressure in a state of being in contact with the piezoelectric element 11 and curing the anaerobic adhesive paste, the piezoelectric element 11 is fixedly joined to the vibration body 12. The anaerobic adhesive paste may be coated on the side of the piezoelectric element 11. An adhesive such as a thermosetting epoxy based adhesive may be used as another joining material, for example.

In a case where the frame body 13 (the one main surface side frame member 131 and the other main surface side frame member 132) is joined to an outer peripheral portion of the main surface of the vibration body 12, for example, the frame body 13 which is processed in a desired shape using a material such as metal such as stainless steel, glass, acrylic resin, polycarbonate resin, or polybutylene terephthalate resin is joined through a joining material.

Further, one end portion of the wiring member 14 for applying voltage to the piezoelectric element 11 is connected to the piezoelectric element 11. A flat plate metal member may be used as the wiring member 14 to be used. Further, when obtaining a configuration in which the slit 141 or the hole 142 of the present embodiment is provided, press machining or etching may be used.

Here, the wiring member 14 is fixedly connected (joined) to the piezoelectric element 11 using a conductive adhesive, for example. For example, a conductive adhesive paste is coated at a predetermined position of the piezoelectric element 11 using a screen printing method or otherwise. Then, by curing the conductive adhesive paste in a state where the wiring member 14 is in contact therewith, the wiring member 14 is fixedly connected to the piezoelectric member 11. The conductive adhesive paste may be coated on the wiring member 14 side. The connection of the wiring member 14 to the piezoelectric member 11 may be performed before the joining of the piezoelectric element 11 and the vibration body 12, or may be performed after the joining thereof.

Further, the other end portion of the wiring member 14 is fixed to the frame body 13 (the one main surface side frame member 131) through an adhesive or a thermocompression bonding sheet. Here, in a case where the frame member 13 (the one main surface side frame member 131) is formed of a conductive material, in order to prevent a short circuit between a positive pole and a negative pole, an intermediate layer 16 formed of an insulating material may be formed on the main surface (upper surface in the drawing) of the frame body 13 (the one main surface side frame member 131) as necessary, and then, the other end portion of the wiring member 14 may be fixed thereto. In a case where the frame body 13 (the one main surface side frame member 131) is not formed of a conductive material, this configuration is not essential.

Further, in a case where a resin layer is provided to cover the piezoelectric element 11, resin may be coated after the frame body 13 is joined.

The acoustic generator according to the present embodiment is obtained by the above-described manufacturing method.

Next, an example of an acoustic generation device 20 according to an embodiment of the invention will be described.

Figure 8:
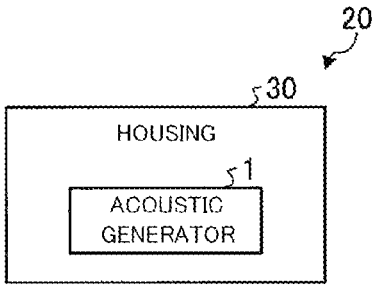
FIG. 8 is a diagram illustrating a configuration of an example of an embodiment of an acoustic generation device according to the present embodiment.

The acoustic generation device refers to a sound generation device such as a so-called speaker. As shown in FIG. 8, the acoustic generation device 20 according to the present embodiment includes the acoustic generator 1, and a housing 30 that accommodates the acoustic generator 1. A part of the housing 30 may be formed by the vibration body 12 that forms the acoustic generator 1, and the accommodation of the acoustic generator 1 in the housing 30 also includes a state where a part (piezoelectric element 11) of the acoustic generator 1 is accommodated in the housing 30.

The housing 30 causes sound generated by the acoustic generator 20 to resonate therein, and radiates the sound through an opening (not shown) formed in the housing 30 to the outside. By providing the housing 30 having such a configuration, it is possible to increase the sound pressure in a low frequency band, for example.

Such an acoustic generation device 20 may be used alone as a speaker, and as described later, may be suitably assembled into a mobile terminal, a flat panel TV, a tablet terminal, or the like. Further, the acoustic generation device 20 may be assembled into home appliances where sound quality is not conventionally emphasized, such as a refrigerator, a microwave oven, a vacuum cleaner, or a washing machine.

Since the above-described acoustic generation device 20 according to the present embodiment is configured using the acoustic generator 1 in which sound pressure and sound quality are enhanced, it is possible to achieve an acoustic generation device with enhanced acoustic performance.

Next, an example of an electronic apparatus according to an embodiment of the invention will be described.

Figure 9:
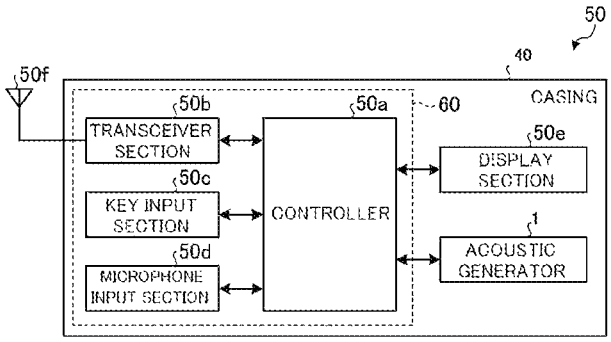
FIG. 9 is a diagram illustrating a configuration of an example of an embodiment of an electronic apparatus according to the present embodiment.

As shown in FIG. 9, an electronic apparatus 50 according to this example includes the acoustic generator 1, an electronic circuit 60 connected to the acoustic generator 1, and a casing 40 that accommodates the electronic circuit 60 and the acoustic generator 1. In the example shown in FIG. 9, it is assumed that the electronic apparatus 50 is a mobile terminal device such as a mobile phone or a tablet terminal.

The electronic apparatus 50 includes the electronic circuit 60. The electronic circuit 60 includes a controller 50*a*, a transceiver section 50*b*, a key input section 50*c*, and a microphone input section 50*d*, for example. The electronic circuit 60 is connected to the acoustic generator 1, and has a function of outputting a signal to the acoustic generator 1. The acoustic generator 1 generates sound based on a signal inputted from the electronic circuit 60.

Further, the electronic apparatus 50 includes a display section 50*e*, an antenna 50*f*, and the acoustic generator 1, and also includes the casing 40 that accommodates these devices. In FIG. 9, a state where the respective devices including the controller 50*a* are all accommodated in one casing 40 is shown, but an accommodation configuration of the respective devices is not particularly limited. In this embodiment, it is sufficient that at least the electronic circuit 60 and the acoustic generator 1 are accommodated in one casing 40.

Here, the acoustic generator 1 is accommodated in the casing 40 by being joined to an inner wall of the casing 40, for example. Here, as a joining material for joining the acoustic generator 1, a joining member that includes a viscoelastic body in at least a part thereof is used. The joining member may be a single body formed by only a viscoelastic body, or may be a complex body formed by plural members including a viscoelastic body. As such a joining material, for example, a double-sided tape in which an adhesive is attached to both sides of a base layer formed of non-woven fabrics may be preferably used. The thickness of the joining member is set to 0.1 mm to 0.6 mm, for example.

A circuit that processes image information displayed on the display or sound information transmitted by a mobile terminal, a communication circuit, or the like may be used as the electronic circuit 60, for example. At least one of these circuits may be used, or all the circuits may be used. Further, a circuit having a different function may be used. Furthermore, plural electronic circuits may be provided. The electronic circuit 60 and the acoustic generator 1 may be connected to each other by a connection wiring.

The controller 50*a* is a control section of the electronic apparatus 50. The transceiver section 50*b* performs data transmission and reception, or the like through the antenna 50*f* based on the control of the controller 50*a*. The key input section 50*c* is an input device of the electronic apparatus 50, and receives a key input operation from an operator. The microphone input section 50*d* is an input device of the electronic apparatus 50, and receives a sound input operation or the like from the operator. The display section 50*e* is a display output device of the electronic apparatus 50, and performs an output of display information based on the control of the controller 50*a*. For example, a known display such as a liquid crystal display or an organic EL display may be preferably used. The display may have an input device such as a touch panel. Here, a part of the casing 40 may be a display. Further, a part of the casing 40 may be a cover of the display, and the display may be disposed therein.

Further, the acoustic generator 1 is operated as an acoustic output device in the electronic apparatus 50. The acoustic generator 1 is connected to the controller 50*a* of the electronic circuit 60, and receives voltage controlled by the controller 50*a* to generate sound.

In FIG. 9, an example in which the electronic apparatus 50 is a mobile terminal device having communication means (communication unit) for performing data transmission and reception, or the like through the antenna is shown, but the type of the electronic apparatus 50 is not particularly limited, and the electronic apparatus 50 may be applied to various consumer appliances having a sound generating function. For example, the electronic apparatus 50 may be applied to various products having a sound generating function, such as a vacuum cleaner, a washing machine, a refrigerator, or a microwave oven, in addition to a flat panel TV or a car audio device, for example.

Since the above-described electronic apparatus 50 according to the present embodiment is configured using the acoustic generator 1 in which sound pressure and sound quality are enhanced, it is possible to achieve an acoustic generation device with enhanced acoustic performance.

Examples

Examples of the acoustic generator according to the invention will be described. Specifically, the acoustic generator shown in FIG. 7 was manufactured as follows.

A piezoelectric element had a structure in which piezoelectric layers having a thickness of 30 μm and internal electrodes were alternately stacked, and the number of piezoelectric layers was eight. The piezoelectric layer was formed of lead zirconate titanate. The internal electrode was formed of silver palladium alloy.

Further, the wiring member was formed using a plate member formed of Corson-based alloy and had a length of 9.2 mm, a width of 1.2 mm, and a thickness of 0.1 mm. Further, three slits were alternately formed in the respective sides of the wiring member which extend in one direction from one end portion of the wiring member. That is, in total, six slits were provided, and holes (total five holes) were provided between the slits. The slit length was 0.80 mm, and the slit width was 0.25 mm. The hole was formed in a shape having a size of 0.8 mm in a width direction perpendicular to the one direction of the wiring member and a size of 0.25 mm in the one direction of the wiring member. The slit interval was 0.9 mm, and an interval between the slit and the hole was 0.45 mm. Further, the one end portion of the wiring member was also provided with a notch and a through hole. On the other hand, this wiring member was compared with a wiring member that fell outside the scope of the invention and was formed in a shape having a length of 9.2 mm, a width of 1.4 mm, and a thickness of 0.07 mm.

Figure 10:
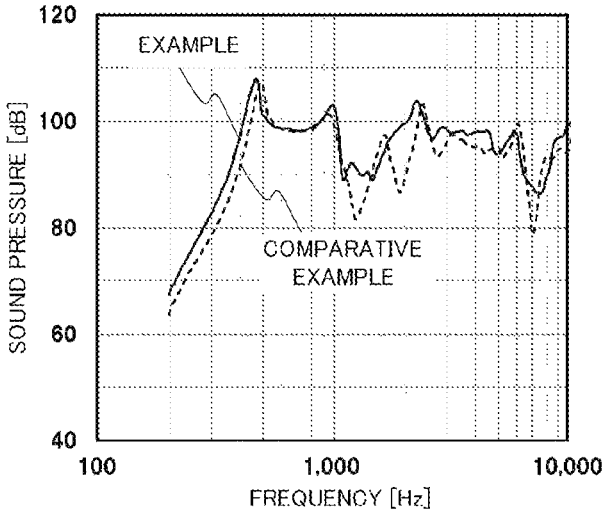
FIG. 10 is a diagram illustrating an example of an sound pressure characteristic of an acoustic generator according to the present embodiment.
Figure 11:
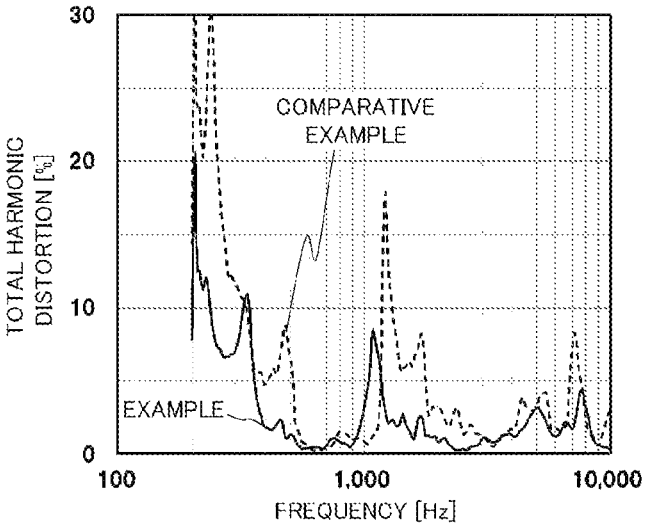
FIG. 11 is a diagram illustrating an example of an distortion characteristic of an acoustic generator according to the present embodiment.

A frequency sweep test from 200 Hz to 20 kHz was performed with respect to the acoustic generator using the wiring member according to the example of the invention while applying a voltage with an effective value of ±7 Vrms to the piezoelectric element at a frequency of 1 kHz, and results of 98 dB in a sound pressure characteristic of 400 Hz and 2% in a distortion factor were obtained as shown in FIGS. 10 and 11. On the other hand, a test under the same conditions as in the above-described acoustic generator according to the example of the invention was performed with respect to an acoustic generator using the wiring member of the comparative example, and results of 93 dB in a sound pressure characteristic of 400 Hz and 5% in a distortion factor were obtained as shown in FIGS. 10 and 11.

By using the acoustic generator according to the invention, it was confirmed that sound pressure could be enhanced, and that a distortion characteristic as an index of sound quality could also be enhanced.

REFERENCE SIGNS LIST

1: Acoustic generator
11: Piezoelectric element
11*a*, 11*b*, 11*c*, 11*d*: Piezoelectric layer
11*e*: Internal electrode layer
11*f*, 11*g*: Surface electrode
11*h*, 11*i*: External electrode
12: Vibration body
13: Frame body
131: One main surface side frame member
132: Other main surface side frame member
14: Wiring member
141: Slit
142: Hole
143: Notch
144: Through hole
145: Bending portion
15: Resin layer
16: Intermediate layer
20: Acoustic generation device
30: Housing
40: Casing
50: Electronic apparatus
50*a*: Controller
50*b*: Transceiver section
50*c*: Key input section
50*d*: Microphone input section
50*e*: Display section
50*f*: Antenna
60: Electronic circuit

The invention claimed is:

1. An acoustic generator, comprising:
a piezoelectric element having a surface electrode;
a vibration body to which the piezoelectric element is attached; and
a wiring member extending in one direction, having a flat shape,
one end portion in the one direction of the wiring member being connected to the surface electrode,
the wiring member including a plurality of slits,
the wiring member being provided with the slits formed in both side portions of the wiring member that extend in the one direction from the one end portion of the wiring member,
the slits formed in one side portion of the side portions and the slits formed in the other side portion of the side portions being disposed at different positions in the one direction and extending in a width direction perpendicular to the one direction,
the wiring member being provided with a hole which is formed between the slits adjacent to each other in the one direction and extends in the width direction.

2. The acoustic generator according to claim 1, further comprising:
a frame body that supports the vibration body, wherein the other end portion of the wiring member is fixed to the frame body,
wherein the plurality of slits are disposed between the piezoelectric element and the frame body.

3. The acoustic generator according to claim 1,
wherein the piezoelectric element includes a main surface having a rectangular shape,
the wiring member is connected to the surface electrode so that a long axis of the piezoelectric element and the one direction are perpendicular to each other,
the one end portion of the wiring member is provided with a notch extending in the one direction from an end surface of the wiring member.

4. The acoustic generator according to claim 1, wherein the one end portion of the wiring member is provided with a through hole.

5. The acoustic generator according to claim 1, wherein the wiring member includes a bending portion that is bent in a thickness direction of the wiring member.

6. The acoustic generator according to claim 1, wherein the wiring member is formed of any one of phosphor bronze, brass, nickel silver, and Corson-based alloy.

7. The acoustic generator according to claim 1, wherein the piezoelectric element is a bimorph multilayered piezoelectric element.

8. An acoustic generation device, comprising:
the acoustic generator according to claim 1; and
a housing that accommodates the acoustic generator.

9. An electronic apparatus, comprising:
the acoustic generator according to claim 1;
an electronic circuit connected to the acoustic generator; and
a casing that accommodates the electronic circuit and the acoustic generator.

10. The acoustic generator according to claim 1, wherein widths of the slits are larger than intervals between the slits adjacent to each other in the one direction.

* * * * *